US010854157B2

(12) United States Patent
Takahashi

(10) Patent No.: US 10,854,157 B2
(45) Date of Patent: Dec. 1, 2020

(54) LIQUID CRYSTAL DISPLAY DEVICE

(71) Applicant: JAPAN DISPLAY INC., Minato-ku (JP)

(72) Inventor: Hideyuki Takahashi, Tokyo (JP)

(73) Assignee: JAPAN DISPLAY INC., Minato-ku (JP)

( * ) Notice: Subject to any disclaimer, the term of this patent is extended or adjusted under 35 U.S.C. 154(b) by 0 days.

(21) Appl. No.: 16/419,114

(22) Filed: May 22, 2019

(65) Prior Publication Data

US 2019/0272797 A1 Sep. 5, 2019

Related U.S. Application Data

(63) Continuation of application No. 15/228,824, filed on Aug. 4, 2016, now Pat. No. 10,380,960, which is a (Continued)

(30) Foreign Application Priority Data

Jan. 10, 2013 (JP) ..... 2013-002915

(51) Int. Cl.
*G09G 3/36* (2006.01)

(52) U.S. Cl.
CPC ..... *G09G 3/3648* (2013.01); *G09G 3/3688* (2013.01); *G09G 2320/0233* (2013.01); *G09G 2320/0247* (2013.01)

(58) Field of Classification Search
CPC ..... G09G 3/3648; G09G 3/3688; G09G 2320/0233; G09G 2320/0247
See application file for complete search history.

(56) References Cited

U.S. PATENT DOCUMENTS 5,892,493 A 4/1999 Enami
2003/0090450 A1 5/2003 Inada
(Continued)

FOREIGN PATENT DOCUMENTS

JP H0667150 A 3/1994
JP 2000-131709 A 5/2000
(Continued)

OTHER PUBLICATIONS

Japanese Office Action dated Mar. 15, 2016, issued in Japanese Patent Application No. 2013-002915 (with English translation).

*Primary Examiner* — Brent D Castiaux
(74) *Attorney, Agent, or Firm* — Oblon, McClelland, Maier & Neustadt, L.L.P.

(57) ABSTRACT

According to one embodiment, a liquid crystal display device includes pixel electrodes arranged in matrix, gate lines, source lines, pixel switches, gate drivers allocated at both ends of a display region, a source driver, image signal transmit lines arranged along the columns in which the pixel electrodes are arranged, each image signal transmit line supplying an image signal to each source line, switches arranged along the row direction, each switch configured to switch a connection between the source line and the image signal transmit line, and control lines configured to output source control signals to switch the switches, each control line outputting a source control signal to switch a plurality of the switches at the same time, wherein each source control signal is input to each control line at a position substantially the center of the gate line in the row direction.

17 Claims, 5 Drawing Sheets

Related U.S. Application Data continuation of application No. 14/151,074, filed on Jan. 9, 2014, now Pat. No. 9,437,153.

(56) References Cited

U.S. PATENT DOCUMENTS

| | | | | |
|---|---|---|---|---|
| 2003/0174107 | A1* | 9/2003 | Watanabe | G09G 3/3688 345/87 |
| 2007/0103421 | A1* | 5/2007 | Sekine | G09G 3/3688 345/100 |
| 2008/0043012 | A1 | 2/2008 | Shirai | |
| 2009/0231324 | A1 | 9/2009 | Kotani | |
| 2010/0128011 | A1 | 5/2010 | Ito | |
| 2011/0249046 | A1 | 10/2011 | Lee | |

FOREIGN PATENT DOCUMENTS

| | | | |
|---|---|---|---|
| JP | 2000-172234 | A | 6/2000 |
| JP | 2001-235723 | A | 8/2001 |
| JP | 2003-345266 | A | 12/2003 |
| JP | 2005-148314 | A | 6/2005 |
| JP | 2006-154808 | | 6/2006 |
| JP | 2010-026138 | A | 2/2010 |
| JP | 2010-054903 | A | 3/2010 |
| JP | 2011-107761 | A | 6/2011 |
| JP | 2012-047807 | A | 3/2012 |

* cited by examiner

LIQUID CRYSTAL DISPLAY DEVICE

CROSS-REFERENCE TO RELATED APPLICATIONS

This application is a continuation of, is based upon and claims priority under 35 U.S.C. § 120 for U.S. application Ser. No. 15/228,824, filed Aug. 4, 2016, which is a continuation of, is based upon and claims priority under 35 U.S.C. § 120 for U.S. application Ser. No. 14/151,074, filed Jan. 9, 2014. U.S. application Ser. No. 14/151,074 claims the benefit of priority Under 35 U.S.C. § 119 from Japanese Patent Application No. 2013-002915, filed Jan. 10, 2013, the entire contents of which are incorporated herein by reference.

FIELD

Embodiments described herein relate generally to a liquid crystal display device.

BACKGROUND

In recent years, flat display devices have been under intense development, and in particular, liquid crystal display devices have become the mainstream of development because they are light, thin, and low in energy consumption, making them ideal for installing in various electronic apparatuses.

A liquid crystal display device comprises a pair of substrates oppose to each other and a liquid crystal layer interposed between the substrates. To control the state of alignment of the liquid crystal, a display device using a TN mode and an OCB mode for a vertical field control and a display device using an in-plane switching (IPS) mode and a fringe field switching (FFS) mode for a horizontal field (including a fringe field) control have been proposed.

BRIEF DESCRIPTION OF THE DRAWINGS

A general architecture that implements the various features of the embodiments will now be described with reference to the drawings. The drawings and the associated descriptions are provided to illustrate the embodiments and not to limit the scope of the invention.

DETAILED DESCRIPTION

Various embodiments will be described hereinafter with reference to the accompanying drawings.

In general, according to one embodiment, liquid crystal display device comprising: pixel electrodes arranged in matrix; gate lines arranged along rows in which the pixel electrodes are arranged; source lines arranged along columns in which the pixel electrodes are arranged; pixel switches configured to switch a connection between the pixel electrodes and the source lines in accordance with drive signals supplied from the gate lines; a first gate driver configured to connect to one end of the gate lines and output the drive signals to the gate lines; a second gate driver configured to connect to the other end of the gate lines and output the drive signals to the gate lines; image signal transmit lines arranged along the columns in which the pixel electrodes are arranged, each image signal transmit line supplying an image signal to each source line; a source driver configured to output the image signals to the image signal transmit lines; switches arranged along the row direction, each switch configured to switch a connection between the source line and the image signal transmit line; and control lines configured to output source control signals to switch the switches, each control line outputting a source control signal to switch a plurality of the switches at the same time, wherein the drive signals output to the gate line from the first and second gate drivers are the same, and each source control signal is input to each control line at a position substantially the center of the gate line in the row direction.

Hereinafter, a liquid crystal display device of an embodiment is described with reference to the drawings.

Figure 1:
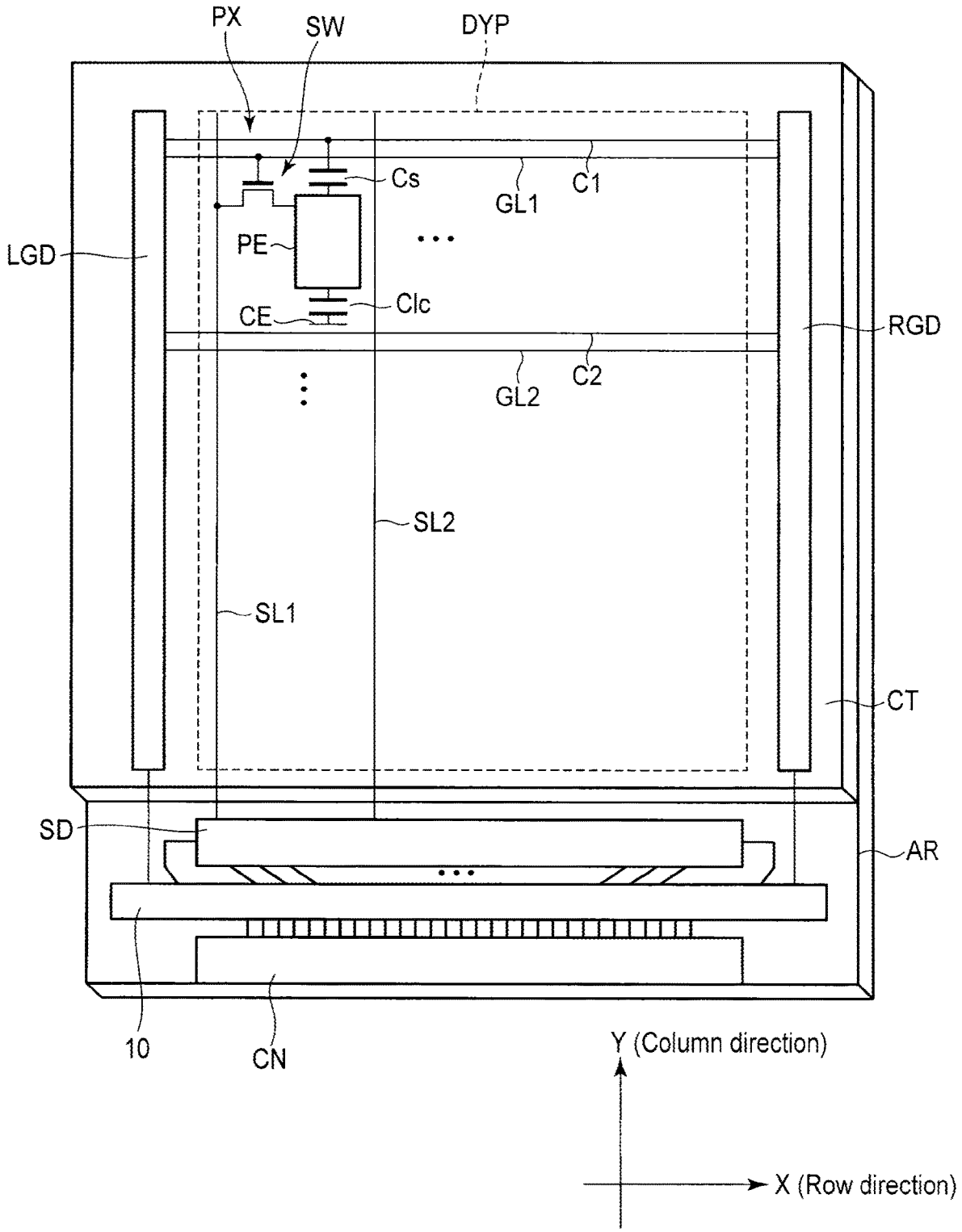
FIG. 1 is a schematic view of a structural example of a liquid crystal display device of an embodiment.

FIG. 1 is a schematic view of a structural example of a liquid crystal display device of a first embodiment. The liquid crystal display device of the present embodiment is, for example, a WVGA color-display device with pixels of 800 lengthwise and 480×3 widthwise (RGB).

The liquid crystal display device of the present embodiment includes an array substrate AR, a counter-substrate CT oppose to the array substrate AR, and a liquid crystal layer interposed between the array substrate AR and the counter-substrate CT.

The array substrate AR includes a transparent insulating substrate, pixel electrodes PE, gate lines GL (GL1, GL2, . . . , GL800) and auxiliary capacitance lines C (C1, C2, . . . ), source lines SL (SL1, SL2, . . . , SL1440 [=480×3]), pixel switches SW, drive circuits, a control IC 10, and a connector CN.

The transparent insulating substrate is made of glass, for example. The pixel electrodes PE are arranged in a matrix on the upper layer of the transparent insulating substrate. The gate lines GL and the auxiliary capacitance lines C extend along respective pixel rows of the pixel electrode PE matrix. The source lines SL extend along respective pixel columns of the pixel electrode PE matrix. A pixel switch SW is arranged at a point close to an intersection of a gate line GL and a source line SL. A drive circuit is arranged around a display region DYP defined by a pixel electrode PE.

A pixel electrode PE is disposed on each pixel PX, that is, each region surrounded by a gate line GL and a source line SL. The pixel electrode PE is formed of a transparent electrode material such as indium tin oxide (ITO) and indium zinc oxide (IZO).

A pixel switch SW includes an n-type thin-film transistor (TFT) as a switching element. The gate electrode of the pixel switch SW and its corresponding gate line GL are electrically connected to each other (or are formed integrally). The source electrode of the pixel switch SW and its corresponding source line SL are electrically connected to each other (or are formed integrally). The drain electrode of the pixel switch SW and its corresponding pixel electrode PE are electrically connected to each other (or are formed integrally).

A drive circuit comprises a gate driver LGD, gate driver RGD, and source driver SD.

Gate driver LGD is disposed on one side of the display region DYP, that is, the left side in terms of the direction in which the gate line GL extends (first direction X). Gate driver RGD is disposed on the other side of the display region DYP, that is, the right side in terms of the direction in which the gate line GL extends (first direction X). One end of the gate line GL and one end of the auxiliary capacitance line C are electrically connected to gate driver LGD. The other end of the gate line GL and the other end of the auxiliary capacitance line C are electrically connected to gate driver RSD. Gate driver LGD and gate driver RGD output a drive signal to the gate line GL sequentially and apply an auxiliary capacitance voltage to the auxiliary capacitance line C sequentially. Gate driver LGD and gate driver RGD output the same signal to each gate line GL and each auxiliary capacitance line C.

Here, although one gate driver drives both the gate line GL and the auxiliary capacitance line C in FIG. 1, the gate line and the auxiliary capacitance line may be driven by different gate drivers.

The source driver SD is disposed on one side of the display region DYP in terms of the direction in which the source line SL extends (second direction Y). One end of the source line SL is electrically connected to the source driver SD.

The connector CN includes a plurality of connecting terminals (using, for example, outer lead bonding [OLB]) connected to an external signal source through, for example, a flex cable. The connecting terminals of the connector CN are electrically connected to the control IC 10 through lines provided in an optional layer of the array substrate AR.

The control IC 10 is crimped to the transparent insulating substrate between the connector CN and the source driver SD. The control IC 10 receives control and image signals from the external signal source through the connector CN. The control IC 10 outputs gate driver control signals to gate drivers LGD and RGD and outputs source driver control and image signals to the source drivers SD in response to the control and image signals received from the external signal source. Note that, basically, there are a plurality of lines connecting the control IC 10 to the drive circuits; however, only one or a few lines are illustrated in the figures for easier understanding of the embodiment.

The counter-substrate CT includes common electrodes CE opposed to the pixel electrodes PE. The common electrodes CE are formed of a transparent electrode material such as ITO and IZO, and a common electrode drive circuit (not shown) applies a common voltage thereto. The common voltage is set as a reference voltage being the exact center with respect to pixel electrode potential written turning to positive/negative in every frame period while compensating offsets due to field-through voltage.

The counter-substrate CT further comprises color filters and a black matrix. The black matrix takes the form of a lattice positioned at the lower layer of the color filters to oppose to the gate lines GL, auxiliary capacitance lines C, and source lines SL, and defines an aperture region of each pixel PX.

The color filters are positioned at the lower layer of the common electrodes CE to correspond to each pixel PX. That is, a part of the color filters is on the black matrix. The color filters provided with the pixel PX adjacent to the first direction X have different colors. That is, the color filters are placed in the display region DYP in stripes.

For example, resin materials in the primary colors red, blue, and green are used for the color filters. A red filter formed of a resin material colored red is positioned to correspond to a red pixel. A blue filter formed of a resin material colored blue is positioned to correspond to a blue pixel. A green filter formed of a resin material colored green is positioned to correspond to a green pixel. The boundaries between the color filters overlap the black matrix. An overcoat layer is applied to the color filters to smooth out the unevenness on the filter surface. The common electrode CE is arranged the overcoat layer.

On the surfaces of the array substrate AR and the counter-substrate CT, a pair of alignment films is provided. The pair of alignment films has been subjected to an alignment process (such as a rubbing treatment and photo-alignment treatment) for initial alignment of liquid crystal molecules of a liquid crystal layer.

A potential difference between the pixel electrode PE and the common electrode CE creates a liquid crystal capacitance Clc in the liquid crystal layer. A potential difference between the pixel electrode PE and the auxiliary capacitance line C creates an auxiliary capacitance Cs which is coupled with the liquid crystal capacitance Clc. The loss of liquid crystal capacitance Clc due to parasitic capacitance after the pixel switch SW is opened is compensated for by the auxiliary capacitance Cs.

On the outer surfaces of the array substrate AR and the counter-substrate CT, a polarizer is attached. A polarizing axis (or absorption axis) of one polarizer is, for example, positioned orthogonal to (in a cross nicol state) a polarizing axis (or absorption axis) of the other polarizer. Here, the one polarizer is positioned in such a manner that the polarizing axis is in parallel with or orthogonal to the initial alignment direction of the liquid crystal molecules.

Figure 2:
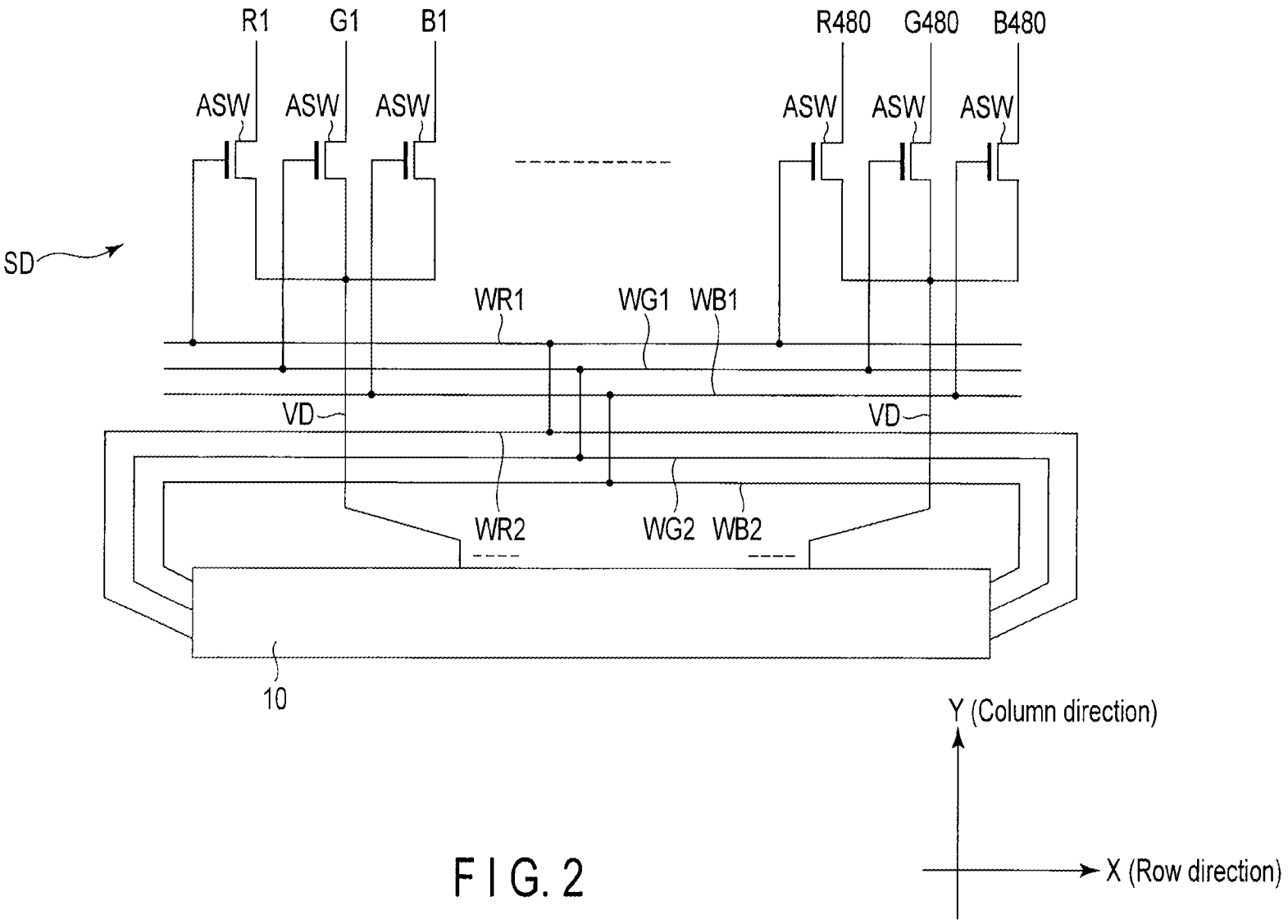
FIG. 2 illustrates a structural example of a source driver shown in FIG. 1.

FIG. 2 illustrates a structural example of the source driver SD shown in FIG. 1.

The source driver SD comprises a control line to which a source control signal is input and an analog switch ASW. The control line includes first control lines WR1/WG1/WB1, and second control lines WR2/WG2/WB2.

The second control lines WR2/WG2/WB2 extend from the control IC 10 in a loop. That is, both ends of the second control lines WR2/WG2/WB2 are connected to the control IC 10. The control IC 10 applies the source control signal to both ends of the second control lines WR2/WG2/WB2.

The first control lines WR1/WG1/WB1 are positioned between the display region DYP and the second control lines WR2/WG2/WB2, and WR1, WG1, and WB1 are distant from one another. In the example of FIG. 2, the first control lines WR1/WG1/WB1 extend substantially in parallel to the gate line GL (substantially in parallel to the first direction X).

The first control line WR1 and the second control line WR2 are electrically connected with each other at substantially the center of the display region DYP in the first direction X. The first control line WG1 and the second control line WG2 are electrically connected with each other at substantially the center of the display region DYP in the first direction X. The first control line WB1 and the second control line WB2 are electrically connected with each other at substantially the center of the display region DYP in the first direction X.

The analog switches ASW are aligned along the first direction X. The analog switch ASW is, for example, an n-type thin-film transistor and switches a connection between the source line SL and image signal transmit line VD. That is, the source electrode of the analog switch ASW is electrically connected to the image signal transmit line VD and a drain electrode of the analog switch ASW is electrically connected to the source line SL corresponding to the image signal transmit line VD.

Each of the image signal transmit line VD is electrically connected to the source electrodes of analog switches ASW adjacent to each other in the first direction X. Each of the image signal transmit line VD is electrically connected to the source lines SL in parallel through the analog switches ASW. In the example of FIG. 2, one image signal transmit line VD is electrically connected to the source electrode of three adjacent analog switches ASW. To each image signal transmit line VD, an image signal corresponding to the red pixel, an image signal corresponding to the green pixel, and an image signal corresponding to the blue pixel are input sequentially.

The gate electrode of the analog switch ASW is electrically connected to the first control lines WR1/WG1/WB1. Specifically, the gate electrode of the analog switch ASW to switch the connection between the source line SL corresponding to the red pixel (R1 to R480) and the image signal transmit line VD are electrically connected to the first control line WR1. The gate electrode of the analog switch ASW to switch the connection between the source line SL corresponding to the green pixel (G1 to G480) and the image signal transmit line VD are electrically connected to the first control line WG1. The gate electrode of the analog switch ASW to switch the connection between the source line SL corresponding to the blue pixel (B1 to B480) and the image signal transmit line VD are electrically connected to the first control line WB1.

Figure 3:
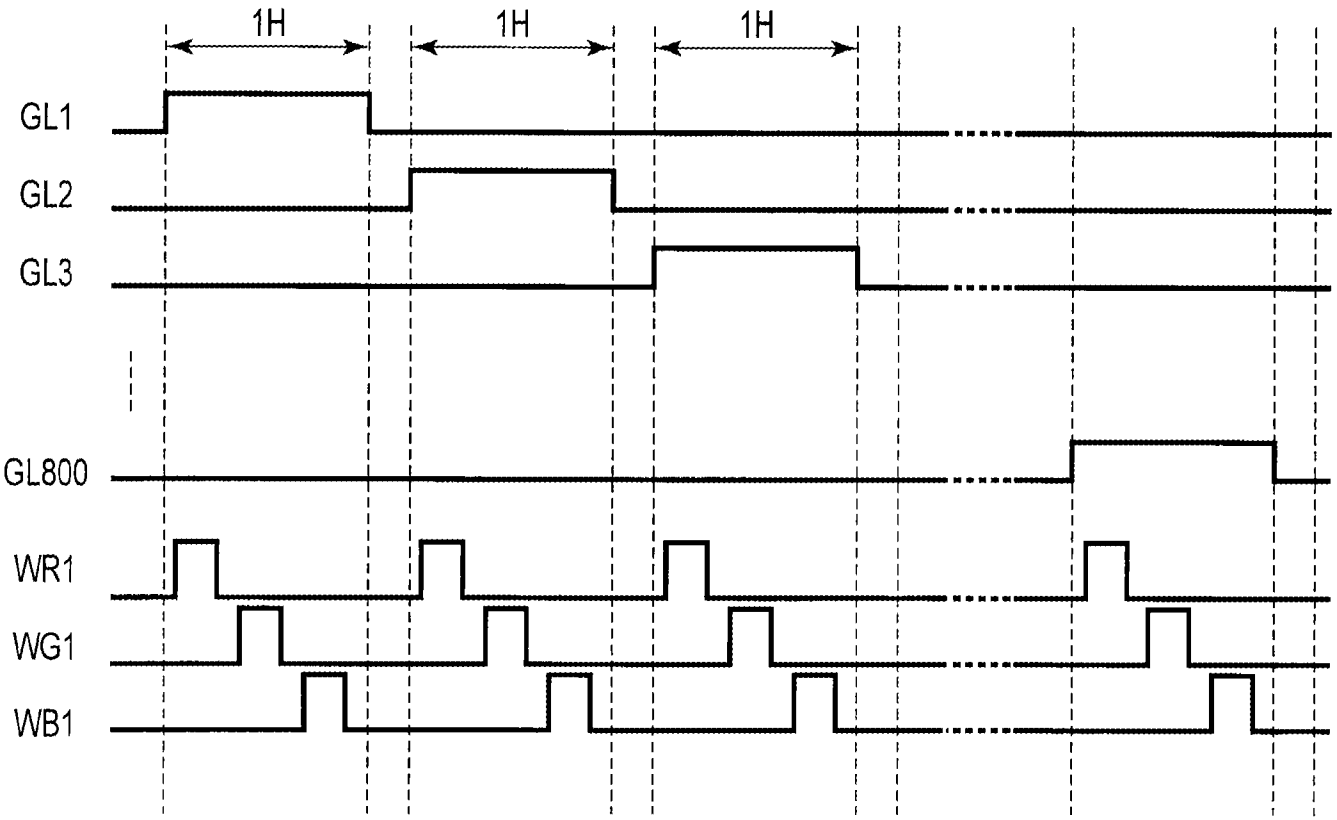
FIG. 3 illustrates an example of a driving method of the liquid crystal display device of an embodiment.

FIG. 3 illustrates an example of a driving method of the liquid crystal display device according to the present embodiment. FIG. 3 shows an example of waveforms of the drive signals supplied from the gate drivers LGD and RGD to the gate lines GL1 to GL800 and waveforms of the source control signals supplied from the control IC 10 to the second control lines WR2/WG2/WB2. Here, the pixel switch SW and the analog switch ASW are, for example, the n-type thin-film transistors configured to conduct electricity between the source and drain electrodes when the gate potential becomes high.

The gate drivers LGD and RGD output the drive signals to the gate lines GL1 to GL800 sequentially. The gate lines GL1 to GL800 are driven for one horizontal period (1H) by the drive signals applied from both ends thereof. While the gate lines GL1 to GL800 are being driven, the electricity is conducted between the source and drain electrodes of the pixel switches SW corresponding to the gate lines, and the image signals are supplied to the pixel electrodes PE from the source lines SL.

The control IC 10 sequentially outputs the source control signal to the second control lines WR2/WG2/WB2 in each horizontal period. The source control signals supplied to the second control lines WR2/WG2/WB2 are then applied to the gate electrodes of the analog switches ASW through the first control lines WR1/WG1/WB1. That is, the source control signal output from the control IC 10 to the second control lines WR2/WG2/WB2 controls the gate potential of the analog switch ASW.

When the source control signal is output to the second control line WR2 at the beginning of one horizontal period, the source and drain electrodes conduct in the analog switch ASW to switch the connection between the source lines SL (R1 to R480) corresponding to the red pixel and the image signal transmit lines VD and the image signals are supplied from the image signal transmit lines VD to the source lines SL (R1 to R480).

Then, when the source control signal is output to the second control line WG2, the source and drain electrodes conduct in the analog switch ASW to switch the connection between the source lines SL (G1 to G480) corresponding to the green pixel and the image signal transmit lines VD and the image signals are supplied from the image signal transmit lines VD to the source lines SL (G1 to G480).

Next, when the source control signal is output to the second control line WB2, the source and drain electrodes conduct in the analog switch ASW to switch the connection between the source lines SL (B1 to B480) corresponding to the blue pixel and the image signal transmit lines VD and the image signals are supplied from the image signal transmit lines VD to the source lines SL (B1 to B480).

As can be understood from the above, the image signals are supplied to the entire source lines SL in a single horizontal period, and the image signals are written to the pixel electrodes PE through the pixel switches SW.

Here, in the pixel PX into which the image signal has already been written, the pixel switch SW is on when the analog switch ASW is off. Thus, field-through voltage of the analog switch ASW is superposed on the potential of the pixel electrode PE through the source line SL. Furthermore, when the gate line GL is off, field-through voltage of the pixel switch SW is superposed on the potential of the pixel electrode PE.

Note that the field-through voltage of each switch element becomes higher as the signal waveform applied to the gate electrode becomes steeper. In the present embodiment, the drive signal is supplied to both ends of the gate lines GL, and thus, the signal applied to the gate electrode of the pixel switch SW at the end portion of the display region DYP in the first direction X draws a steep waveform, and the signal applied to the gate electrode of the pixel switch SW at the center part of the display region DYP draws a relatively loose waveform. Therefore, the field-through voltage of the pixel switch SW is higher at the end portion of the display region DYP and is lower at the center part of the display region DYP.

On the other hand, the first control lines WR1/WG1/WB1 are connected to the second control lines WR2/WG2/WB2 at the center part of the display region DYP in the first direction X, and thus, the signal waveform of the first control lines WR1/WG1/WB1 become steep at the center part of the display region DYP and becomes loose at the end portion of the display region DYP. This means that the field-through voltage of the analog switch ASW is higher at the center part of the display region DYP and is lower at the end portion of the display region DYP.

Consequently, in the pixel PX at the end portion of the first direction X, the field-through voltage of the pixel switch SW becomes high and the field-through voltage of the analog switch ASW becomes low. In the pixel PX at the center part of the first direction X, the field-through voltage of the pixel switch SW becomes low and the field-through voltage of the analog switch ASW becomes high.

That is, the field-through voltage of the analog switch ASW becomes low in the pixel PX where the field-through voltage of the pixel switch SW becomes high, and the field-through voltage of the pixel switch SW becomes high in the pixel PX where the field-through voltage of the pixel switch becomes low. Therefore, the offset unevenness with respect to counter-electrode potential by the field-through voltage can be reduced in the display region DYP entirely.

The counter-electrode potential is set as a reference voltage being the exact center with respect to pixel electrode potential written turning to positive/negative in every frame period while compensating offsets due to field-through voltage. If the counter-electrode potential is offset from the center of the pixel electrode potential, the voltage applied to the liquid crystal in odd frames differs from that in even frames. If this voltage difference becomes sufficiently large, screen flicker occurs. Furthermore, a direct current (DC) component applied to the liquid crystal may cause image burn-in or the like on the screen and display quality may deteriorate as a result.

In contrast to this, the liquid crystal display device of the present embodiment reduces the offset unevenness by the field-through voltage on the entire display region DYP. That is, the problem that voltage applied to the liquid crystal in odd frames is different from that in even frames can be prevented with respect to a predetermined counter-electrode potential. Consequently, the present embodiment can provide a liquid crystal display device which suppresses flicker and image burn-in issues and improves display quality.

Note that, although both ends of the control IC 10 output exactly the same signal to the second control lines WR2/WG2/WB2 in the present embodiment described above, this is simply for the sake of conciseness. That is, the control IC 10 may output the source control signal to one side of the second control lines WR2/WG2/WB2. The same advantage can be obtained as long as the connection position between the second control lines WR2/WG2/WB2 and the first control lines WR1/WG1/WB1 is maintained as described above. For example, if the control IC 10 outputs the source control signal directly to the first control lines WR1/WG1/WB1 at substantially the center of the display region DYP in the first direction X, the second control lines WR2/WG2/WB2 can be omitted.

Now, a liquid crystal display device of a second embodiment is explained with reference to the drawings. Hereinafter, structures corresponding to those of the first embodiment are denoted with the same reference numerals and their detailed explanation is omitted.

Figure 4:
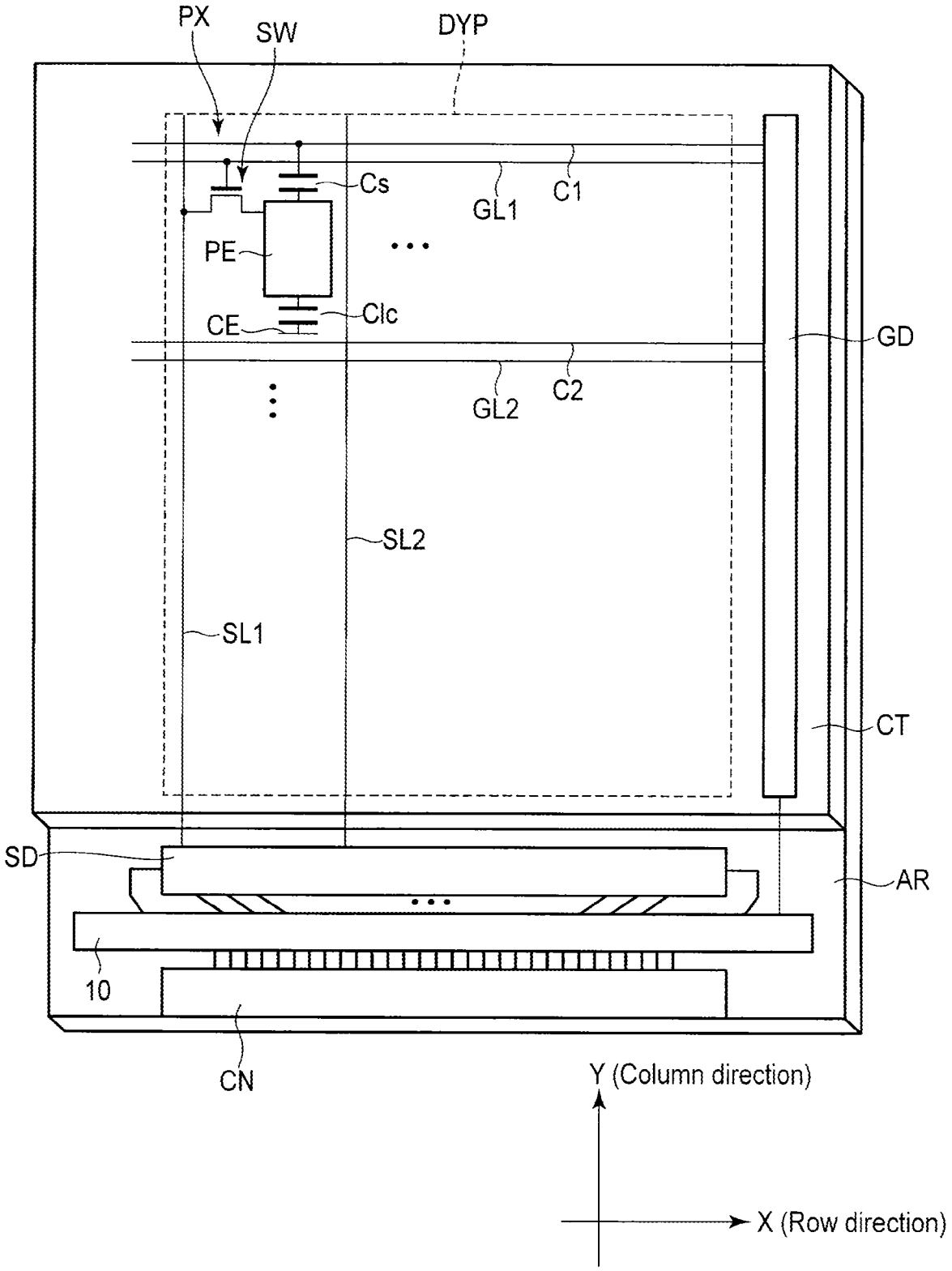
FIG. 4 is a schematic view of a structural example of a liquid crystal display device of an embodiment.

FIG. 4 is a schematic view of a structural example of a liquid crystal display device according to the second embodiment.

In the liquid crystal display device of the present embodiment, a drive circuit is structurally different from that of the liquid crystal display device of the first embodiment.

The drive circuit comprises a gate driver GD and a source driver SD. The gate driver GD is disposed on one side of the display region DYP in the first direction X. The source driver SD is disposed on one side of the display region DYP in the second direction Y.

One end of the gate line GL and one end of the auxiliary capacitance line C are electrically connected to the gate driver GD. The gate driver GD outputs drive signals to the gate line GL sequentially and applies auxiliary capacitance voltage to the auxiliary capacitance line C sequentially.

The control IC 10 outputs the source control signal to the source driver SD from the other side of the display region DYP in the first direction X.

Figure 5:
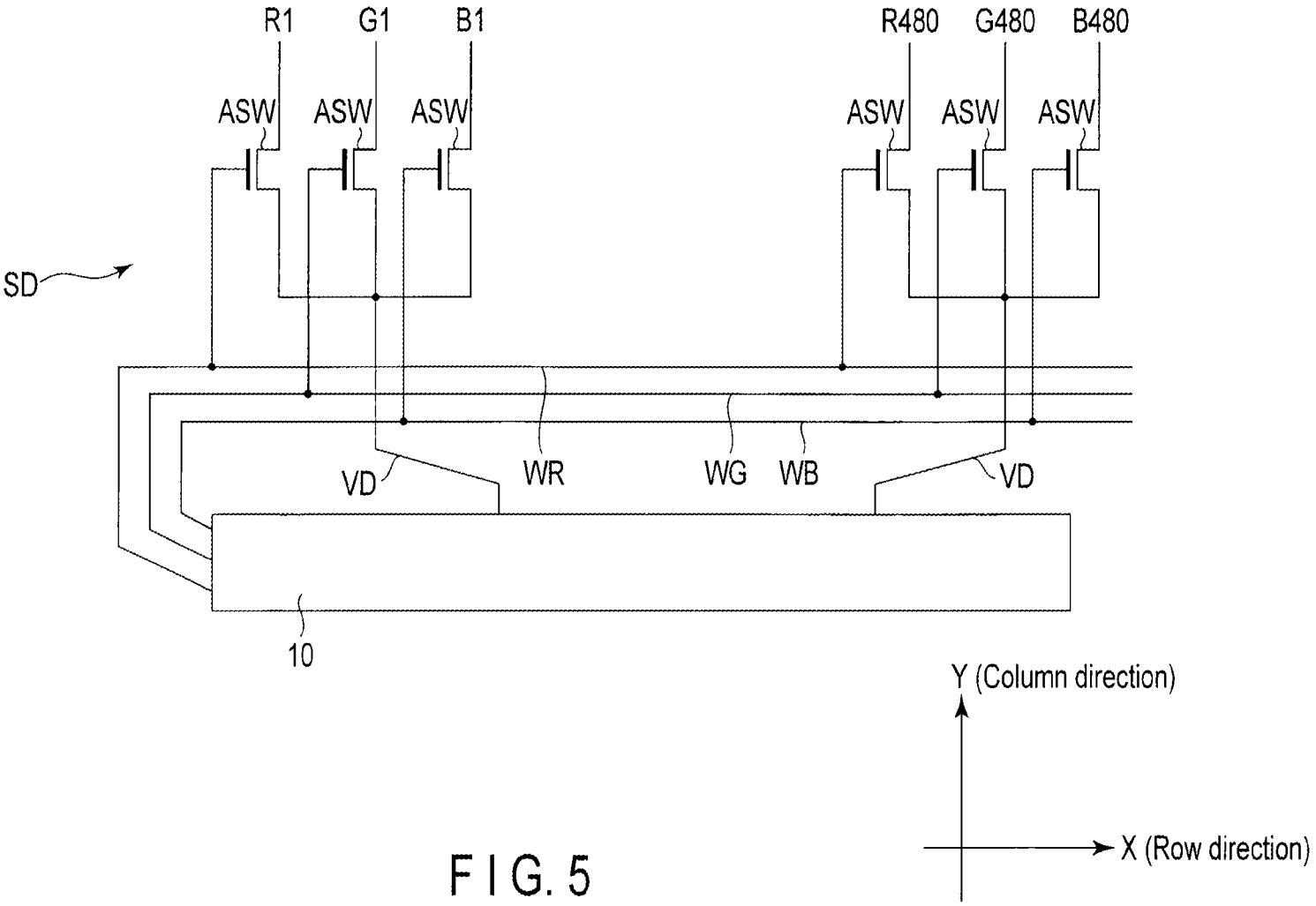
FIG. 5 illustrates a structural example of a source driver shown in FIG. 4.

FIG. 5 illustrates a structural example of the source driver SD shown in FIG. 4.

The source driver SD comprises control lines WR/WG/WB and an analog switches ASW. The control lines WR/WG/WB of the present embodiment function as both the first control lines WR1/WG1/WB1 and the second control lines WR2/WG2/WB2 of the first embodiment.

One end of each control line WR/WG/WB connects to the control IC 10 at the side opposite to the gate driver GD in terms of direction X and extends in direction X. The control IC 10 applies the source control signal from the starting point side of control lines WR/WG/WB in the first direction X.

The analog switch ASW is, for example, an n-type thin-film transistor and switches a connection between source line SL and image signal transmit line VD. That is, the source electrode of the analog switch ASW is electrically connected to the image signal transmit line VD, and a drain electrode of the analog switch ASW is electrically connected to the source line SL corresponding to the image signal transmit line VD.

Each of the image signal transmit lines VD is electrically connected to the source electrodes of the analog switches ASW adjacent to each other. Each of the image signal transmit lines VD is connected to source lines SL through the analog switch ASW. In the example of FIG. 5, one image signal transmit line VD is electrically connected to the source electrodes of three adjacent analog switches ASW. To each image signal transmit line VD, an image signal corresponding to the red pixel, an image signal corresponding to the green pixel, and an image signal corresponding to the blue pixel are input sequentially.

The gate electrode of the analog switch ASW is electrically connected to the control lines WR/WG/WB. Specifically, the gate electrodes of the analog switches ASW to switch the connections between the source lines SL corresponding to the red pixels (R1 to R480) and the image signal transmit lines VD are electrically connected to the control lines WR. The gate electrodes of the analog switches ASW to switch the connections between the source lines SL corresponding to the green pixels (G1 to G480) and the image signal transmit lines VD are electrically connected to the control lines WG. The gate electrodes of the analog switches ASW to switch the connections between the source lines SL corresponding to the blue pixels (B1 to B480) and the image signal transmit lines VD are electrically connected to the control lines WB.

In the liquid crystal display device of the present embodiment, drive signals supplied by the gate driver GD to gate lines GL1 to GL800 and the source control signals supplied by the control IC 10 to the control lines WR/WG/WB produce waveforms similar to those in FIG. 3.

In the liquid crystal display device of the present embodiment, the drive signal is supplied to the gate line GL from the one side of the first direction X (from the right side in FIG. 4). Therefore, field-through voltage of a pixel switch SW at one end of the display region DYP in the first direction X becomes high while field-through voltage of a pixel switch SW at the other end of the display region DYP in the first direction X becomes low.

On the other hand, the source control signal is supplied to the control line WR/WG/WB from the other side of the first direction X (from the left side in FIG. 5) and the signal waveforms of the control line WR/WG/WB is steep at the other side of the first direction X. Therefore, field-through voltage of the analog switch ASW at the other end of the display region DYP in the first direction X becomes high while field-through voltage of the analog switch ASW at the one end of the display region DYP in the first direction X becomes low.

Consequently, in the pixel PX at the end portion of the other side (left side) of the first direction X, the field-through voltage of the pixel switch SW becomes low and the field-through voltage of the analog switch ASW becomes high. In the pixel PX at the end portion of the one side (right side) of the first direction X, the field-through voltage of the pixel switch SW becomes high and the field-through voltage of the analog switch ASW becomes low.

That is, as with the case of the first embodiment, the field-through voltage of the analog switch ASW becomes low in the pixel PX where the field-through voltage of the pixel switch SW becomes high, and the field-through voltage of the pixel switch SW becomes high in the pixel PX where the field-through voltage of the pixel switch becomes low. Therefore, the offset unevenness with respect to counter-electrode potential by the field-through voltage can be reduced in the display region DYP entirely.

Consequently, the present embodiment can provide the liquid crystal display device of good display quality.

Note that, if the source control signals are output in parallel to the control lines WR/WG/WB from both ends of the control IC 10 as in the first embodiment, the same advantage can be obtained if the control lines WR/WG/WB are routed to the left end once, then extended to the right side, and the gate potential of the analog switch ASW is input thereto as shown in FIG. 5.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. A display device comprising:

a substrate;

pixel electrodes arranged in a matrix in a display region of the substrate;

gate lines arranged on the substrate and extending along a first direction in which the pixel electrodes are arranged;

source lines arranged on the substrate and extending along a second direction that crosses the first direction;

pixel switches configured to switch connection between the pixel electrodes and the source lines in accordance with drive signals supplied from the gate lines;

a peripheral region located around a periphery of the display region of the substrate;

switches arranged in the peripheral region along the first direction;

a signal source located in the peripheral region;

first control lines electrically connected to gate electrodes of the switches and extending along the first direction;

second control lines electrically connected to the first control lines; and image signal transmit lines electrically connected to source electrodes of the switches and extending along the second direction, wherein the source lines are electrically connected to drain electrodes of the switches, the signal source supplies a source control signal to the second control lines and an image signal to the image signal transmit lines, the second control lines are located between the image signal transmit lines in planar view, and the image signal transmit lines each cross the first control lines at positions between the switches and the signal source in planar view.

2. The display device according to claim 1, wherein the second control lines extend along the second direction.

3. The display device according to claim 1, wherein the first control lines and the second control lines are connected to each other in a center of the first control lines in the first direction.

4. The display device according to claim 1, wherein the first control lines and the second control lines are directly connected to each other.

5. The display device according to claim 1, wherein the second control lines are not directly connected to the switches.

6. The display device according to claim 1, wherein the image signal transmit lines are directly connected to the signal source.

7. The display device according to claim 1, further comprising:

third control lines electrically connected to the signal source and the second control lines, and extending along the first direction, wherein each of the second control lines is electrically connected to a corresponding one of the third control lines in a center of the third control lines in the first direction.

8. The display device according to claim 7, wherein the second control lines are electrically connected to the signal source through the third control lines.

9. The display device according to claim 7, wherein the third control lines are directly connected to the signal source.

10. The display device according to claim 1, wherein the signal source is a control IC, and the control IC is mounted on the substrate.

11. A display device comprising:

a substrate;

pixel electrodes arranged in a matrix in a display region of the substrate;

gate lines arranged on the substrate and extending along a first direction in which the pixel electrodes are arranged;

source lines arranged on the substrate and extending along a second direction that crosses the first direction;

pixel switches configured to switch connection between the pixel electrodes and the source lines in accordance with drive signals supplied from the gate lines;

a peripheral region located around a periphery of the display region of the substrate;

switches arranged in the peripheral region along the first direction;

a signal source located in the peripheral region, first control lines electrically connected to gate electrodes of the switches and extending along the first direction;

second control lines electrically connected to the first control lines and extending along the second direction; and image signal transmit lines electrically connected to source electrodes of the switches and extending along the second direction, wherein the signal source supplies a source control signal to the second control lines, each of the gate lines are connected to gate drivers which output the drive signals, the image signal transmit lines each cross the first control lines at positions between the switches and the signal source in planar view, the source lines are electrically connected to drain electrodes of the switches, each of the first control lines and a corresponding one of the second control lines are electrically connected by a corresponding one of first contact portions, the first contact portions are located in a center of the first control lines in the first direction, and the first contact portions are located between the switches in the first direction.

12. The display device according to claim 11, further comprising:

third control lines electrically connected to the signal source and the second control lines, and extending along the first direction, wherein each of the second control lines and a corresponding one of the third control lines are electrically connected by a corresponding one of second contact portions, and the second contact portions are located in a center of the third control lines in the first direction.

13. The display device according to claim 12, wherein the second control lines are electrically connected to the signal source through the third control lines.

14. The display device according to claim 11, wherein the second control lines are not directly connected to the switches.

15. The display device according to claim 11, wherein the first control lines and the second control lines are directly connected to each other.

16. The display device according to claim 12, wherein the second control lines and the third control lines are not directly connected to the switches.

17. The display device according to claim 12, wherein the first control lines and the second control lines are directly connected to each other, and the second control lines and the third control lines are directly connected to each other.

* * * * *